United States Patent [19]

Hubert

[11] 4,123,155

[45] Oct. 31, 1978

[54] COPY PRODUCTION MACHINE HAVING A DUPLEX COPY MODE

[75] Inventor: Wallace L. Hubert, Boulder, Colo.

[73] Assignee: International Business Machines Corporation, Armonk, N.Y.

[21] Appl. No.: 729,453

[22] Filed: Oct. 4, 1976

[51] Int. Cl.[2] ..... G03B 27/32; G03G 15/00

[52] U.S. Cl. ..... 355/26; 355/14; 355/77

[58] Field of Search ..... 355/23-26, 355/14, 77

[56] References Cited

U.S. PATENT DOCUMENTS

| | | | |
|---|---|---|---|
| 3,806,242 | 4/1974 | Reehil | 355/14 |
| 3,813,157 | 5/1974 | Fantozzi | 355/14 |
| 3,848,995 | 11/1974 | Gauronski | 355/14 |
| 4,008,957 | 2/1977 | Summers | 355/14 |
| 4,067,649 | 1/1978 | Hubbard et al. | 355/14 |

*Primary Examiner*—L. T. Hix

*Assistant Examiner*—W. J. Brady

*Attorney, Agent, or Firm*—H. F. Somermeyer

[57] ABSTRACT

A copy production machine operates either in a simplex mode (each copy has an image only on one side) or in a duplex mode (copies have images on both sides). In the duplex mode, an interim storage unit stores partially completed copies (only one side of the duplex copies have an image). A second copy run completes duplex copy production. During power on sequencing, circuits sense for an intermediate copy production state (also termed intermediate state or intermediate operating state) and automatically makes machine selections for a copy production mode in accordance with the sensed intermediate state. In one early embodiment the intermediate state was copies residing in the interim storage unit and the selected copy production mode was the production of side two in a duplex mode. An electronic nonvolatile memory may also store intermediate state indications for use during power on sequencing.

12 Claims, 9 Drawing Figures

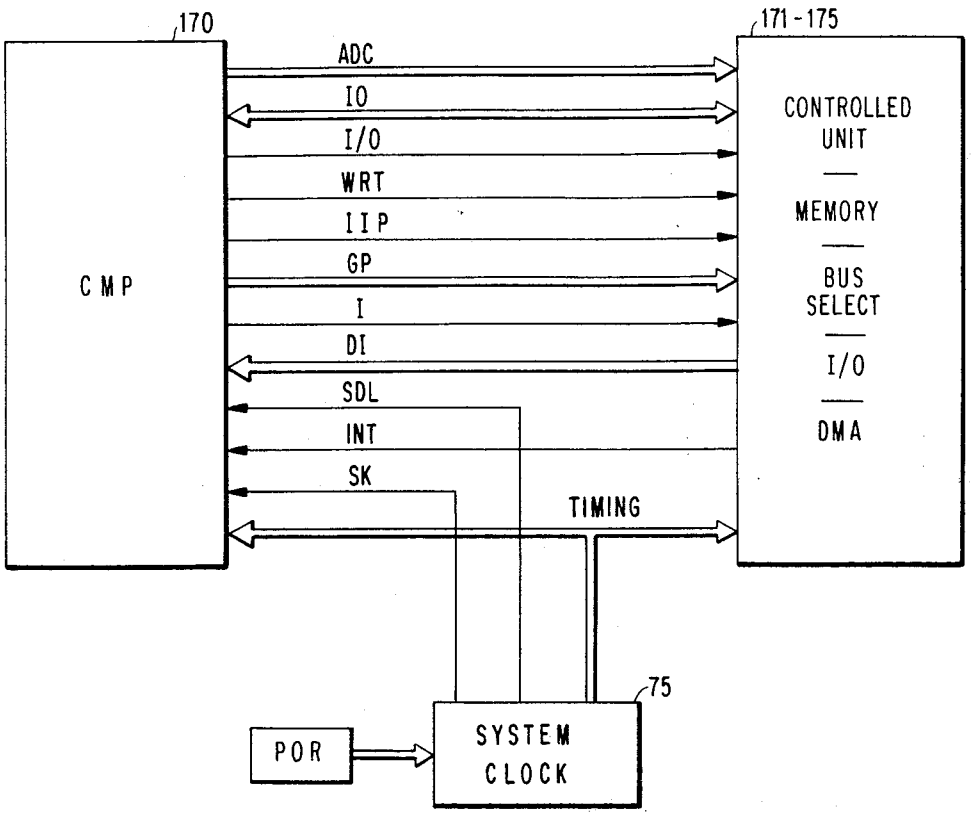
FIG. 4
FIG. 3
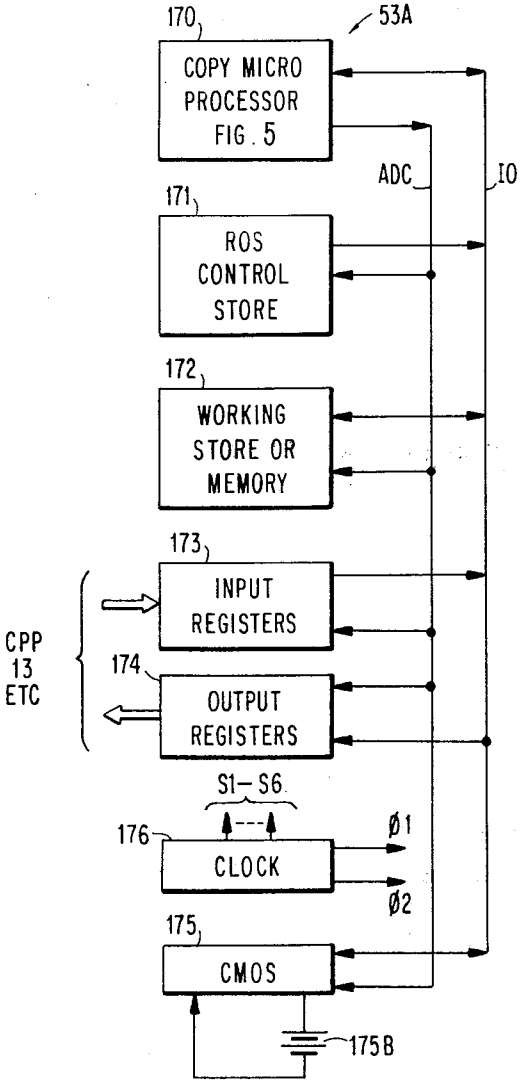

| INSTR | SEQ 1 CL | SEQ 1 ALU | SEQ 2 CL | SEQ 2 ALU | SEQ 3 CL | SEQ 3 ALU | SEQ 4 CL | SEQ 4 ALU | SEQ 5 CL | SEQ 5 ALU | SEQ 6 CL | SEQ 6 ALU |
|---|---|---|---|---|---|---|---|---|---|---|---|---|
| AR SR LR | IBL | M | (TB⇒IB) IRH | M X | PCI | M NOTE 4 | (TERM) | NOTE 4 | | | | |
| LRE LRD | IBL | M | (TB⇒IB) IRH | M X | PCI | M NOTE 5 | WRT IRL | NOTE 5 | WRT IRH | TBNS (XX→DB) ACH + DO | (TERM) | TBNS |
| STR | PCI | M | (TB⇒IB) WRT IRH | X (X→DB) ACH→DO | WRT IRL | ACL→DO | (TERM) | TBNS | | | | |
| AI SI | PCI | M | PCI | M NOTE 1 | (TERM) | NOTE 5 | | | | | | |
| CI GPI [LI XI OI NI] | PCI | M | PCI | M ACL x TB → DO → [ACL] | (TERM) | X | | | | | | |
| CB [AB SB LB XB OB NB] | PCI | M | TB | M (ACL→DO) | (TB⇒IB) PCI | X | (TERM) | ACL ± TB → DO → [ACL] | | | | |
| STB | PCI | M | WRT TB | ACL→DO | (TB⇒IB) PCI | X | (TERM) | X | | | | |
| AI SI SHL SHR | PCNI | M | (TB⇒IB) PCI | M NOTE 2 | (TERM) | NOTE 2 | | | | | | |
| TRA | PCI | M | (TERM) | NOTE 3 | | | | | | | | |
| CLA [IC] | PCI | M CL AC / SET IC | (TERM) | X COT* → EQ | | | | | | | | |
| TBP [TBR] | PCI | M | (TERM) | ACL M → DO → [ALL] | | | | | | | | |
| POR (IJD) | | | | | | | IB→"CLA" POR CODE | X RST LOGIC 32→DO | | | | |
| TIME | Ø2 220 | Ø1 | Ø2 | Ø1 | Ø2 | Ø1 | Ø2 | Ø1 | Ø2 | Ø1 | Ø2 | Ø1 Ø2 |

INSTRUCTION PREVIOUS

NOTE 1: ACL ± TB ; + DB→ACH ; ACH→DO→ACL
NOTE 2: ACL MODIF→DB→ACH ; ACH→DO→ACL
NOTE 3: ACL→DB→ACH ; ACH→DO→ACL
NOTE 4: ACL ± TB→DB→ACH ; ACH→DO→ACL
NOTE 5: ACL +Δ→BB→ACH ; ACH→DO→ACL

FIG. 6

| INSTR | SEQ 1 CL | SEQ 1 ALU | SEQ 2 CL | SEQ 2 ALU | SEQ 3 CL | SEQ 3 ALU | SEQ 4 CL | SEQ 4 ALU | SEQ 5 CL | SEQ 5 ALU | SEQ 6 CL | SEQ 6 ALU |
|---|---|---|---|---|---|---|---|---|---|---|---|---|
| BAL | PCI | | IB SET PCI | (ACH→DO) ACL→DB | NOTE 7 | PCL→DO | WRT IRH | PCH−1 + CR →DO | NOTE 9 | NOTE 10 | (TERM) | SET TRA |
| RTN | IBL | | IRH | NOTE 5 | IRL + 8 | (ACH→DO) ACL→DB | NOTE 8 | NOTE 10 | PCI | NOTE 11 | (TERM) | (ACL→DO) |
| BØØ | PCNI | | NOTE 3 | PCH−1 →[AOH] | PCI | X | (TERM) | X | | | | |
| $\overline{\text{BØØ}}$ | PCI | | PCI | X | (TERM) | X | | | | | | |
| IJO | PCNI | | NOTE 4 | PCH−1 →[ACH] | PCI | X | (TERM) | X | | | | |
| $\overline{\text{IJO}}$ | PCI | | (TERM) | X | | | | | | | | |
| BLI | IBL | | (TB⟹IB) IRH | NOTE 5 | PCI | (ACH→DO) ACL→DB | ACL→AOH TB→AOL | NOTE 10 | (TERM) | ITAL | | |
| BSI | IBL | | (TB⟹IB) IRH | NOTE 5 | PCI | (ACH→DO) ACL→DB | WRT ACL→AOH TB→AOL | NOTE 10 | (TERM) | TBNS | | |
| IN | PCI | | OUT 1st IO WRT TB | NOTE 6 | OUT 2nd IO WRT TB | ACL→DO | (TB⟹IB) PCI | X | (TERM) | IOD AC7*→EQ | | |
| OUT | PCI | | OUT 1st IO WRT TB | NOTE 6 | OUT 2nd IO WRT TB | ACL→DO | (TB⟹IB) PCI | X | (TERM) | IOD AC7*→EQ | | |
| INTERUPT 1-5 | NOTE 1 | | STR ACH WRT 4H | NOTE 5 | STR LOW AC WRT 4L | ACL→DB ACH→DO | STR OLD STAT WRT 8L | TBNS STAT →DO→ACL | HI ADD READ 12 H | TBNS PCL→DO →ACL | (TERM) | |
| INTERUPT 6-10 | NOTE 2 | ACL−1→DO | STR PCH WRT OH | PCH−1 + CR →DO | NEW STAT 8H | X | NOTE 9 | NOTE 10 | PCI | UPDATE STAT | (TERM) | |

PREVIOUS INSTRUCTION

220 Ø1 Ø2 Ø1 Ø2 Ø1 Ø2 Ø1 Ø2 Ø1 Ø2 Ø1 Ø2

NOTE 1: LOW ADDRESS READ 12 L
NOTE 2: STR PCL WRT OL
NOTE 3: CAL HIGH BITS; TB→AOL
NOTE 4: CAL HIGH BITS; IB→AOL
NOTE 5: ACL→DB→ACH; ACH→DO→ACL
NOTE 6: TB (MODIFIED)→DO
NOTE 7: SET IB TO "TRAP"; WRITE IRL
NOTE 8: UPDATE PC; ACL→ACH; TB→ACL
NOTE 9: UPDATE PC; ACL→AOH; TB→AOL
NOTE 10: ACL→AOH; DB→ACH; ACH→DO→ACL
NOTE 11: (ACL→DO) STAT
UPDATE IF REGO GRPO

FIG. 7

| | GROUP | MEMORY TYPE |
|---|---|---|
| ZONE 3 | 31 | DIAGNOSTIC SPACE |
| | 30 | REPLICATE I/O |
| | 29 | CMOS |
| | 28 | |
| | 27 | WORK REGISTERS |
| | 26 | |
| | 25 | |
| | 24 | |
| ZONE 2 | 23 | DIAGNOSTIC SPACE |
| | 22 | REPLICATE I/O |
| | 21 | CMOS |
| | 20 | |
| | 19 | WORK REGISTERS |
| | 18 | |
| | 17 | |
| | 16 | |
| ZONE 1 | 15 | DIAGNOSTIC SPACE |
| | 14 | REPLICATE I/O |
| | 13 | CMOS |
| | 12 | |
| | 11 | WORK REGISTERS |
| | 10 | |
| | 9 | |
| | 8 | |
| ZONE 0 | 7 | DIAGNOSTIC SPACE |
| | 6 | REPLICATE I/O |
| | 5 | CMOS |
| | 4 | |
| | 3 | WORK REGISTERS |
| | 2 | |
| | 1 | |
| | 0 | |

COPY PRODUCTION MACHINE HAVING A DUPLEX COPY MODE

DOCUMENT INCORPORATED BY REFERENCE

The present invention includes improvements over the invention set forth in copending commonly assigned patent application Ser. No. 651,883, filed Jan. 23, 1976, now U.S. Pat. No. 4,067,649.

BACKGROUND OF THE INVENTION

The invention relates to copy production machines, in particular to those copy production machines operable in a duplex mode and having a power on sequence.

Prior copy production machines, such as convenience copiers, have often operated in both a simplex and duplex copy production mode. Most copiers operable in both modes often have an interim storage unit termed a "duplex" tray or "auxiliary" tray for temporarily storing the partially reproduced copies; i.e., those copies have an image impressed on but one side. Upon completion of the production of the single-image interim duplex copies, a second original, or the opposite side of a single original, is placed upon a platen or document glass for reproduction on the second side of the partially reproduced copies. Then, a second run of the copier is initiated wherein the copies in the interim storage unit are transferred through a copy production process for receiving an image on the second-side. Then, the completed duplex copies are transferred to an output unit which may include a single tray or a collator. Accordingly, duplex copying machines have provisions for directing copies from the copy production process to either the output portion or to the interim storage unit (for receiving the partially reproduced copies). All copies of one original image are termed a copy set. It is desired to have all copy sets in the output portion.

In producing two-sided copies in the duplex mode, a problem arises when there is an odd number of images to be copied. In such an instance, the last copy set of the duplex run resides in the interim storage unit and not in the normal output portion of the machine. Of course, if there is an even number of images, then all copy sets will be in the output portion.

Prior machines have permitted the last copy set to remain in the interim storage means requiring an operator to open the machine and remove the last copy set from the machine and then combine that last copy set with the previous copy sets already in the output portion. The above operator action is quite simple if the machine is in a noncollate mode or does not have a collator. However, if each copy set has up to 100 copies and a collator is in the output portion, then the operator must hand collate all 100 copies of the last copy set with the previously automatically collated copy sets.

To avoid the hand collation, it is possible in some copy machines to initiate an additional copy run whereat the reverse side of the platen is copied on the back side of the copies in the last copy set. This may result in pictures of transport wheels and the like being impressed upon the back side of the last copy set, which may be objectionable in some copy production. This action may also result in graying or other marks being imposed on the back side of the copies in the last copy set. In those machines charging the user by the number of images produced, the latter requires an additional charge for completing the run automatically. That is, the user is charged for running the last copy set through the machine even though the user desires no image to be put on the back side of the copies of the last copy set.

All of the above copy producing actions in handling an odd number original duplex copy run require thoughtful action on the part of the operator. For convenience purposes, it is desirable to minimize such action by the operation by making the document reproduction machine as fully automatic as possible. Such ease of operation facilitates greater throughput of the copy production machine.

SUMMARY OF THE INVENTION

It is an object of this invention to provide a copy production machine capable of preselection of operating copy production modes without operator intervention.

In accordance with one aspect of the invention, a copy production machine includes means manifesting an intermediate copy production state (intermediate state or intermediate operating state) and for manifesting same during power off conditions. During a power on sequence the copy production machine responds to the manifested intermediate state for selecting a copy production mode in accordance with such manifested intermediate state.

In a specific aspect of the invention an intermediate state includes storage of image bearing documents or copies in a particular portion of the machine which indicate that certain predetermined copy production actions must be taken with respect to such image bearing documents. In a more particular aspect of the invention the image bearing documents are copies having images on but one side thereof, and residing in a location of the machine indicating that images are to be impressed on both sides of the copy sheet.

In another aspect of the invention a plurality of different intermediate states may be simultaneously indicated and copy production machine automatically responds to such plurality of intermediate states to select a plurality of copy production modes in accordance therewith.

The foregoing and other objects, features, and advantages of the invention will be apparent from the following more particular descriptions of preferred embodiments of the invention, as illustrated in the accompanying drawings.

THE DRAWING

FIG. 3 is a block diagram of programmable control circuits for controlling a machine using the present invention.

FIG. 4 is a block diagram showing data transfer controls within the FIG. 3 illustrated circuits.

FIGS. 6 and 7 are charts showing instruction execution of the FIG. 5 illustrated computer element.

DETAILED DESCRIPTION

Figures 1, 2:
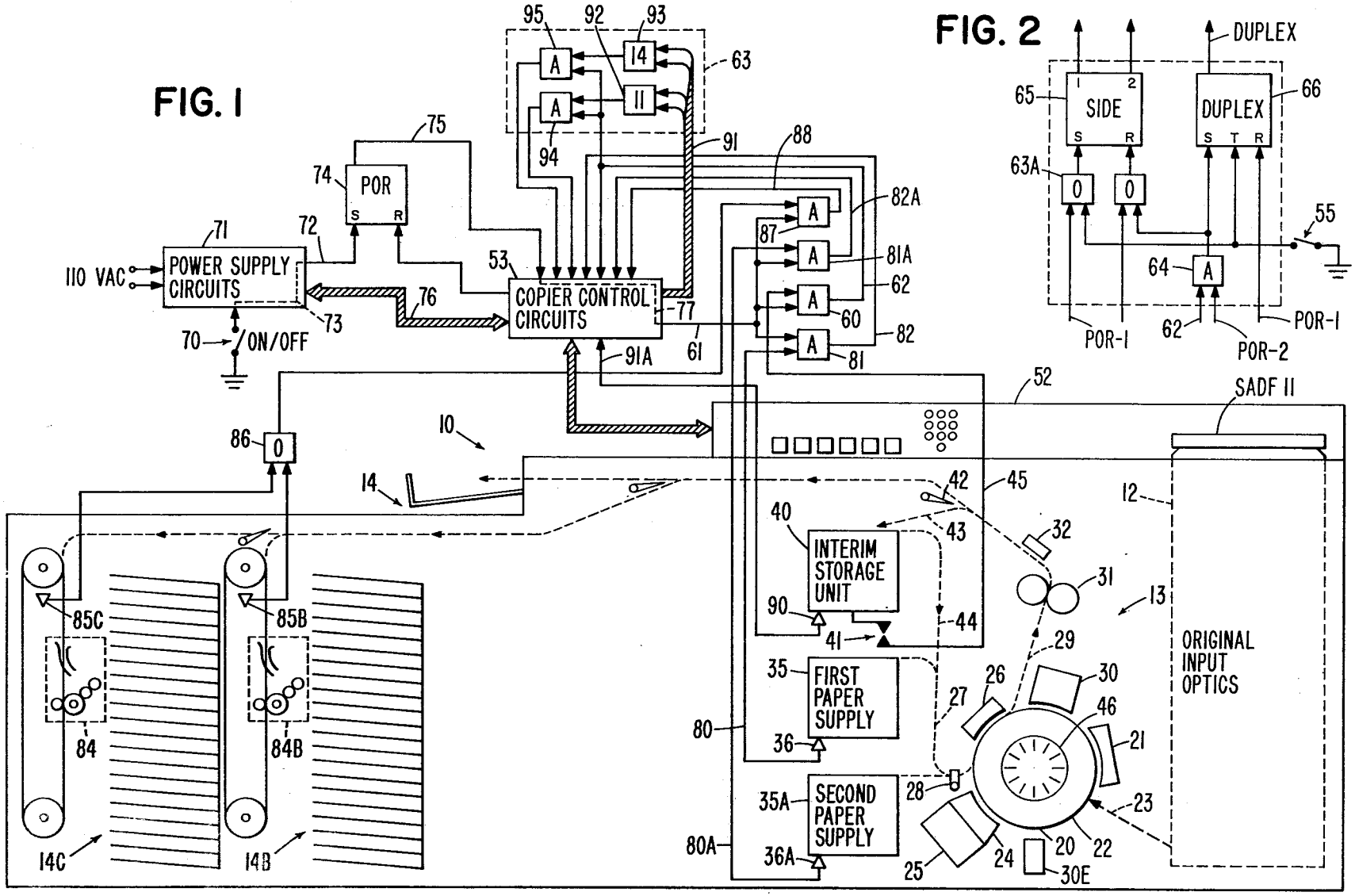
FIG. 1 is a diagrammatic showing of one embodiment of the present invention.
FIG. 2 is a diagram of a duplex mode control usable with the FIG. 1 illustrated machine.

Referring now more particularly to the drawings, like numerals indicate like parts and structural features in the diagrams. A copy production machine 10 has a semiautomatic document feed (SADF) 11 for transporting originals past an original input optic portion 12. The SADF 11 has a platen or document glass (not shown) scanned by optics (not shown) within portion 12 for transferring images of the original documents to document reproduction portion 13 of the copy production machine 10. The images transmitted through portion 13 are impressed upon paper and supplied as copies to output copy handler 14, which includes a bin or copy tray 14A, collators 14B, 14C, and the like.

When operating in a duplex mode, portion 13 operates in a succession of single-image copy runs, each single-image run consisting of a plurality of copy production cycles, each cycle represented by the passage of an image area on photoconductor transfer member 20 past image-receiving area 22 which receives the image to be reproduced from portion 12, as indicated by dashed line arrow 23. During each single-image run, the operator controls of copy production machine 10, except for the stop button, are disengaged. At the end of a single-image run, i.e., the transfer of one image to a plurality of copies, operator selections are enabled. Also, insertion of an original document into SADF 11 causes it to be automatically transferred to the platen (not shown) for being scanned by original input optics 12. Hence, for each two-image duplex copy transported to the output copy handler 14, there are two successive single-image runs by document reproduction portion 13. A duplex copy run consists of a succession of such single-image runs.

Before proceeding further with the description of the invention, the operation of document reproduction portion 13 is described as a constructed embodiment of a so-called xerographic copy production machine. The photoconductor member 20 rotates in the direction of the arrow past a plurality of xerographic processing stations. The first station in xerographic reproduction process is charging station 21 which imposes either a positive or negative electrostatic charge on the surface of photoconductor member 20. It is preferred that this charge be a uniform electrostatic charge over a uniform photoconductor surface. Such charging is done in the absence of light such that projected images, indicated by dash line arrow 23, alter the electrostatic charge on the photoconductor member in preparation for image developing and transferring. Exposure in area 22 exposes the photoconductor surface which was charged to a bright light by the image projected by original input optics 12. Light reflected from the original document discharges the areas on the photoconductor surface in accordance with lightness. With minimal light reflected from the dark or printed areas of the original document, there is no corresponding discharge. As a result, an electrostatic charge remains in those areas of the photoconductive surface corresponding to the dark or printed areas of the original document in SADF 11. This charge pattern is termed a "latent" image on the photoconductive surface. Interimage erase lamp 30E discharges photoconductor member 20 outside defined image areas.

The next xerographic station is the developer 24 which receives toner (ink) from toner supply 25 for being deposited on the photoconductive surface having charged areas. The developer station receives the toner with an electrostatic charge of polarity opposite to that of the charged areas of the photoconductive surface. Accordingly, the toner particles adhere electrostatically to the charged areas, but do not adhere to the discharged areas. Hence, the photoconductive surface, after leaving station 24, has a toned image corresponding to the dark and light areas of an original document in SADF 11.

Next, the latent image is transferred to copy paper in tranfer station 26. The paper is brought to the station 26 from an input paper path portion 27 via synchronizing input gate 28, thence through transfer station 26 and, finally, along paper path 29. The copy paper is brought into contact with the toned image on the photoconductive surface resulting in a transfer of the toner to the copy paper. After such transfer, the sheet of copy paper is stripped from the photoconductive surface for transport along path 29. Next, the paper has the image fused thereon in fusing station 31 creating a permanent image on the copy paper. Such copy paper receives electrostatic charges which have an adverse affect on copy handling. Accordingly, the copy paper after fusing is electrically discharged at station 32 before transfer to output portion 14.

Returning now to the photoconductor member 20, after the image area leaves transfer station 26, there is a certain amount of residual toner on the photoconductive surface. Accordingly, cleaner station 30 has a rotating cleaning brush to remove the residual toner for cleaning the image area in preparation for receiving the next image projected by original input optics 12. The cycle then repeats by charging the just-cleaned image area by charging station 21.

The production of simplex copies or the first side of duplexing copies by portion 13 includes transferring a blank sheet of paper from blank paper supply 35, thence to transfer station 26, fuser 31, and, when in the simplex mode, directly to the output copy portion 14. Blank paper supply 35 has an empty sensing switch 36 which inhibits operation of portion 13 in a known manner whenever supply 35 is out of paper.

When in the duplex mode, duplex diversion gate 42 is actuated by the duplex controlling circuits 50 to the upward position for deflecting single-image copies to travel over path 43 to the interim storage unit 40. Here, the partially produced duplex copies (image on one side only) reside waiting for the next subsequent single-image run in which the copies receive the second image. Such copies residing in interim storage unit 40 is an intermediate copy production state.

In the next-successive single-image run, initiated by inserting a document into SADF 11, the copies are removed one at a time from the interim storage unit 40, transported over path 44, thence to path 27 for receiving a second image, as previously described. The two-imaged duplex copies are then transferred into output copy portion 14. For purposes of the present invention, a switch 41 of interim storage unit 40 detects whether or not there are any copies of paper in interim storage unit 40. If so, an intermediate copy production state signal is supplied over line 45 to later described control circuits.

The copy production machine 10 has a control panel 52 having a plurality of lights and switches (most not shown), as well as a set of copier control circuits 53 which operate the entire machine 10 synchronously with respect to the movement of the image areas of photoconductor member 20. Billing meter M of circuits 53 counts images processed for billing purposes. For example, paper release gate 28 is actuated synchronously with the image areas moving past developer station 24. Such controls are well known in the art and are not described here for purposes of brevity.

In accordance with the invention, copier production modes in machine 10 are preset in accordance with sensed intermediate states. One of the sensible intermediate states being sensed is by switch 41 sensing that intermediately produced copies are residing in interim storage unit 40. The intermediate state signal on line 45 actuates AND circuit 60 to respond to a later described POR state signal received over line 61 to supply a duplex mode selection signal over line 62 to copier control circuits 53, as well as to auxiliary copier control circuits 63, as later described. The circuits within copier control circuits 53 relating to the line 62 signal are shown in detail in FIG. 2. The side indicating latch 65 indicates either a first or second side is being produced in a duplex mode. During initial power-on-reset an early timing pulse POR-1 travels through OR circuit 63 setting side latch 65 to the one indicating state; i.e., normally one expects no copies to reside in interim storage unit 40; however, a later POR timing pulse POR-2 samples AND circuit 64 which responds to the line 62 signal to supply resetting pulse to side latch 65 thereby indicating that side 2 is to be produced by the copy production machine 10. Additionally, duplex latch 66 is initially reset by the POR-1 timing pulse. However, AND circuit 64 additionally sets the duplex latch to the duplex selecting state simultaneously with resetting side latch 65 to indicate side 2. Setting latch 66 selects the duplex copy production mode in machine 10.

Other controls in FIG. 2 include a duplex selecting switch 55 which is physically on panel 52 which triggers duplex latch 66 between set and reset states; i.e., between duplex and nonduplex modes. The same switch supplies its signal through OR circuit 63A to set side latch 65 to the one state; i.e., if the copy production machine during its power-on-reset sequencing selects the duplex mode and the production of side 2 by respectively setting latches 66 and 65, the operator can intercede and frustrate the selection by depressing the duplex latch for deselecting the duplex mode and forcing the side latch to the side 1 state. Accordingly, even though the copy production machine 10 automatically selects copy production modes in accordance with the intermediate state indicated by copies in interim storage unit 40, an operator can override the automatic selection. When overridden and before the start of copy production, the copy production machine 10 automatically moves the copies from the interim storage unit 40 to exit tray 14A without imposing images thereon. Such controls are beyond the present invention and are not described for that reason.

Returning now to power on sequencing. The copy production machine 10 includes master on/off switch 70 which turns power supply circuits 71 on and off. Power is supplied from 110 VAC power line and includes the usual voltage regulators, current regulators, and power on sequencing circuits. In response to switch 70 being closed, power supply circuits 71 supply an activating signal over line 72; the response of circuits 71 to switch 70 being indicated by dotted line 73. The line 72 signal sets POR latch 74 to the active state. Latch 74 being set to the active state indicates the power-on-reset; i.e., machine 10 is being powered on under control of power supply circuits 71. This signal indication is supplied over line 75 to copier control circuits 53 which include additional condition and response connections with power supply circuits 71 as indicated by cable 76. As soon as copier control circuits 53 receive the line 75 POR signal, circuits 53 supply an actuating POR state signal over line 61 in response to POR latch 74 as indicated by dashed line 77. POR state signal on line 61 actuates AND circuit 60 to sense intermediate state indicating switch 41 for enabling selection of the duplex copy production mode.

Copy production machine 10, like many copy production machines, has a plurality of paper supplies. A first paper or copy sheet supply 35 is considered the normal paper supply; i.e., has the largest number of sheets of copy paper for receiving images from transfer station 26. A second paper supply 35A may contain other size copy sheets such as 8.5 × 13 inches where first paper supply 35 contains 8.5 × 11 inch paper. Under control panel 52 control, copy production portion 13 can receive paper from either first paper supply 35 or second paper supply 35A. On occasion first paper supply 35 may run out of copy sheets. Such lack of supply is indicated by a switch 36 which supplies an AND gate enabling signal over line 80 to AND circuit 81. AND circuit 81 passes the line 80 signal whenever the POR signal on line 61 is active. The AND circuit 81 signal travels over line 82 to copier control circuits 53 for selecting second paper supply 35A as a source of copy paper. Such selection eliminates the need to illuminate the add paper light and require operator intervention before copy production can ensue. Additionally, second paper supply 35A has a sensing switch 36A supplying a similar signal over line 80A to AND circuit 81A. AND circuit 81 in turn supplies a select first paper supply signal over line 82A. Copier control circuits 53 respond to signals on both lines 82 and 82A to communicate an add paper message to the operator. Similarly, if line 82A is active and line 82 is not, then first paper supply 35 is selected. In the event neither line 82 nor 82A supply a signal, the normal or first paper supply 35 can also be selected.

Copy production machine 10 can include collators 14B and 14C. The position of the copy sheet transport carriages 84B and 84C being from away from their home position is sensed by switches 85B and 85C, respectively. Such nonhome positioning indicates that prior to power off copy production machine 10 was in a collate mode and that collation was not completed. Accordingly, the signals from switches 85B, 85C are supplied through OR circuit 86 to signify the above described intermediate operational state. AND circuit 87 responds to the POR line 61 signal and to the OR circuit 86 signal to select the collate mode by setting the latch (not shown) in copier control circuits 53 via signal on line 88. In a further enhancement of the present invention the actual position of carriage 84B, 84C can be sent thereby indicating a precise intermediate operational state of the collators 14B, 14C. By sensing such position copy production can ensue in the collation mode by inserting copies into the appropriate bins; i.e., the physical location, of the collator carriages, all of which is indicated by counters or program data signals in copier control circuits 53 which is not described for purposes of brevity.

As aforestated, first and second paper supplies 35, 35A may contain different size copy sheets. One of the differently sized sheets can reside in interim storage unit 40 when duplex mode is present in the copy production machine. Accordingly, interim storage unit 40 may have size sensing set of switches diagrammatically represented by numeral 90 which supplies signals over cable 91A to copier control circuits 53 which decode the switches 90 signals for supplying selection signals over cable 91 to auxiliary control circuits 63. The cable 91 signal set and reset paper size indicating latches 92, 93 for respectively indicating whether 8.5 × 11 inch or 8.5 × 13 inch paper resides in interim storage unit 40. In the event that switches 90 and switch 41 indicate no copy paper in the interim storage unit 40, latches 92, 93 both remain reset. With copy paper in interim storage unit 40 the intermediate state indicated by switch 41 is further refined by the switches 90 signifying the length or size of paper. When the intermediate state latches 92, 93 are active AND circuits 94, 95 are enabled to pass the line 62 signal (select duplex during POR) for modifying the copy production mode in accordance with the copy paper size in interim storage unit 40. AND circuits 94, 95 supply paper size selecting signals over lines 96, 97 to copier control circuits 53. Control circuits 53 respond to the lines 96, 97 control signals to adjust the operation of copy production portion 13 as is well known in the art.

It is preferred that switches 90 not sense the paper in interim storage unit 40 rather switches 90 can be on panel 52 as copy length selection switches. In the latter instance circuits 63 form a portion of a random access nonvolatile memory CMOS such as CMOS 175 later described with respect to FIG. 3. In this instance the selection of paper length as manifested by the signal states of latches 92, 93 constitute an indication of an intermediate state selection in that paper length selection is a copy production state existing during a copy production run and necessary to successful conclusion thereof.

Timing signals on POR-2 are generated in copier control circuits 53 in a known manner such as by a shift register driven by an oscillator. POR-1 occurs just prior to POR-2. It must be understood that power-on-reset sequencing may include a plurality of such timing pulses; for example, up to 153 such pulses.

In the event machine 10 has a recirculating automatic document feed (not shown), switches/lights may sense positions of original documents to be reproduced. Such positions of original documents within such document feed constitutes intermediate operating states capable of being sensed for imposing a copy production mode on machine 10; i.e., select automatic document feed as an image source rather than SADF 11 or other possible image sources (not shown). In fact, any sensible state may be used by the inventive control for preselection of copy production modes in copy production machine 10.

Processor Control System

Sequence control circuits 53 preferably include a programmable computer control system as shown in FIG. 3. The programmable control 53A includes a programmable single chip microprocessor CMP 170 operating based upon a set of control programs contained in ROS control store 171, and uses working store or memory 172 as a main or working store. CMP 170 communicates with the other units of circuits 53A as well as CPP 13, SADF 11 output portion 14 and control panel 52, as later discussed, via the input registers 173 and output registers 174. In a preferred constructed embodiment, IO bus is eight bits wide (1 character) plus parity. Address signals selecting which units are to send or receive signals with respect to CMP 170, as well as the other units, are provided by CMP 170 over 16 bit side address bus ADF. A nonvolatile store CMOS 175 is a battery 175B powered semiconductor memory using CMOS construction. A clock 176 supplies later described timing signals to units 170–175.

Referring next to FIG. 4, the logical interconnections between microprocessor 170 with controlled units 171–175 are shown. All of the signals on the busses and individual control lines go to all units with the ADC signals selecting which controlled unit 171–175 is to respond for either receiving data signals or supplying data signals, respectively, over bus IO. Control line I/O indicates whether CMP 170 is supplying or receiving signals in bus IO. When the I/O line has a binary 1 indicating signal data or instruction signals are to be transferred to the microprocessor 170 over IO while when it is a binary zero microprocessor 170 supplies data signals over IO. Write line WRT indicates to memory 172 that signals are to be recorded in the memory. The IIP line, the signal IIP indicates interrupt in process, i.e., the microprocessor 170 program has been interrupted and microprocessor 170 is handling that interrupt. I is interrupt, SDL (data latch) is received from system clock 176, and means data signals from IO are to be latch in microprocessor 170. The line SK means sliver-killer which is a control signal for eliminating extraneous signals commonly referred to as slivers. These so-called signals result in interaction between successively actuated bistable circuits termed latches. Other timing signals for coordinating operation of all of the units 171–175 are received from system clock 176. Additionally, power-on reset circuit POR activates system clock 75 to send out timing signals and control signals for resetting all of the units 170–175 to a reference state as is well known in the computer arts.

The Microprocessor 170

Figure 5:
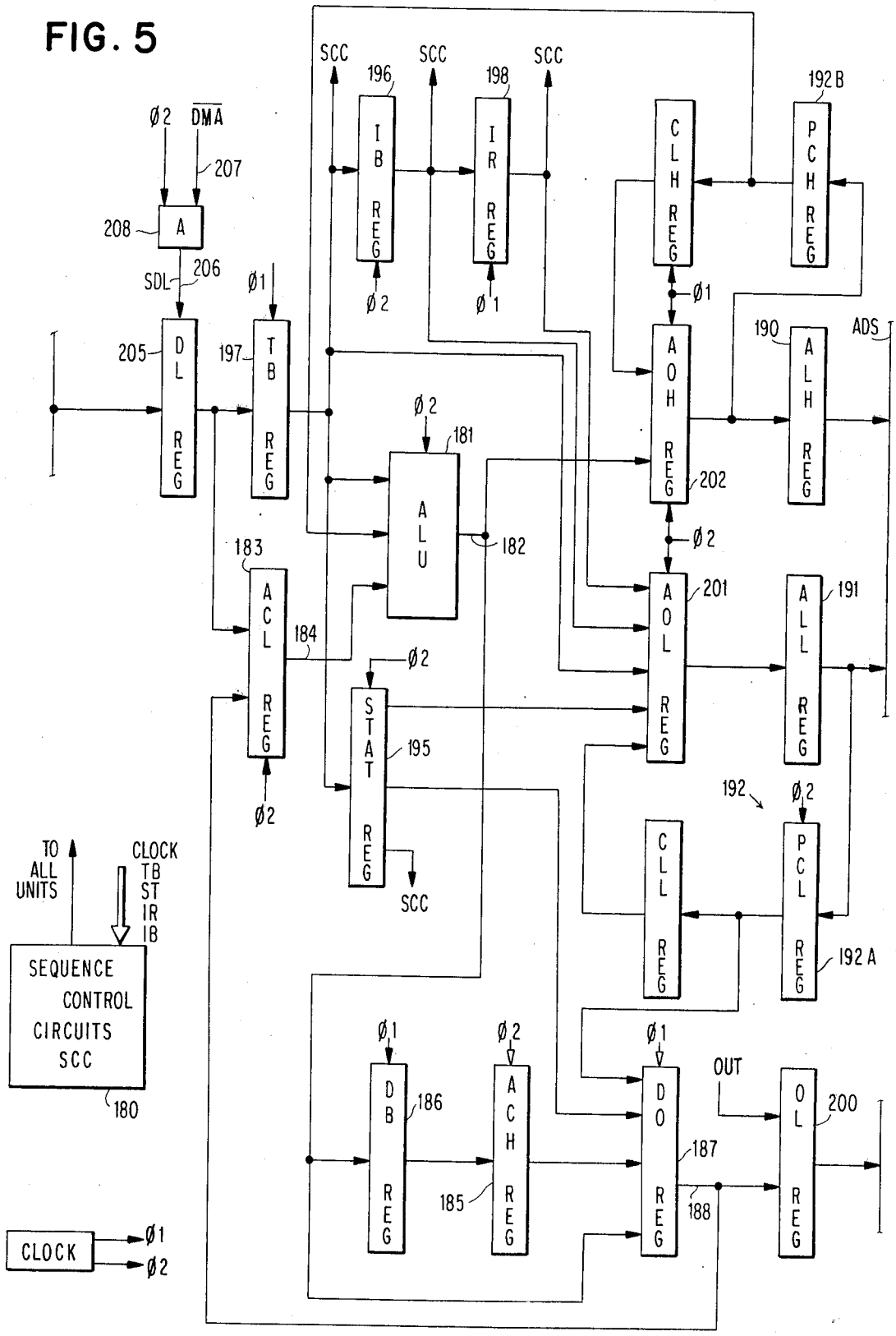
FIG. 5 is a diagram of a computer element used in the FIG. 3 illustrated circuits.

Referring next to FIG. 5, the data flow of the microprocessor 170 is detailed. The sequence control circuits 180 are those logic circuits designed to implement the now to be described functions performable in the timing context of the following description. Such sequence control circuits SCC 180 include instruction decoders, memory latches and the like, for sequencing the operation of the FIG. 6 illustrated data-flow circuits, using a two-phase clock, $\phi 1$, $\phi 2$ from clock 176. The processor contains an 8 bit wide (1 character wide) arithmetic and logic unit ALU 181. ALU 181 receives signals to be combined during a $\phi 2$ and supplies static output signals over ALU output bus 182 during each phase 1. Operatively associated with ALU 181 is a 16 bit accumulator consisting of two registers, a low register ACL 183 which has its output connections over 8 bit wide bus 184 as one input to ALU 181. The second register of the accumulator is ACH register 185. When the microprocessor 170 operates with a two character wide or 2 byte wide word, the functions of ACL 183 and ACH 185 alternate. That is, in a first portion of the operation, which requires two complete microprocessor 170 cycles, as later described, ACL 183 contains the lower order 8 bits of a 16 bit wide word, while ACH 185 contains the upper 8 bits of the 16 bit wide word. ALU 181 first operates on the lower 8 bits received over ACL bus 184 and supplies the result signals over ALU output bus 182 to DB register 186. During this same transferring action, ACH 185 is supplying the upper 8 bits through DO register 187, thence over DO bus 188 to ACL 183. During the next ALU cycle, the upper 8 bits are operated upon. In the preferred and constructed embodiment, ALU 181 operates with two's complement notation and can perform either 8 bit wide or 16 bit wide arithmetic as above described. Eight bit wide logical operations are also performed.

ALU 181 contains three indicating latches (not shown) which memorize the results of arithmetic and logical functions for use in later processor cycles, such as conditional jumps or branches, and so-called input carry instructions. There three indicators are low, equal (EQ), and carry. Utilization of these indicators will be better understood by continued reading of the specification. Processor sequence control circuits 180 can entertain a single level of interrupt and includes an internal interrupt mask register (not shown) for disabling interrupts as is well known in the computer arts. The low order bits of the address signals supplied to bus ADS by the ALH register 190 (high order bits of the address) and ALL register 191 (the low order 8 bits of the address) are denominated as work registers. These registers are divided into 16 groups of 16, 2 byte wide, logical registers. A portion of ALL register 191 supplies GP signals for selecting which groups of registers are accessible by microprocessor 170.

As will be later detailed, microprocessor 170 requires two processor cycles for processing an I/O instruction. The first cycle is a set-up cycle while the second cycle is a data transfer cycle. When an I/O operation requires a transfer of a succession of bytes, then the first cycle sets up a unit 171–175 for transferring a plurality of bytes such that the I/O operation appears as a set-up cycle followed by a plurality of data transfer cycles. The microprocessor 170 is designed to operate with a plurality of relatively slow acting devices; i.e., copy production machine 10. The time required for the microprocessor 170 to perform its functions is relatively small compared to the time required by the controlled devices. Accordingly, under clock 176 control, the microprocessor 170 can be effectively turned off to allow a controlled device to have exclusive use of the IO bus.

From examination of FIG. 5, it can be seen that all of the registers, being latches, will maintain their respective signal states whenever the clock phases, $\phi 1$ and $\phi 2$, are not supplied. Therefore, upon an interruption of the microprocessor 170 functioning by a controlled device 171–175, the signal state of the processor 170 enables it to begin operating again as if there had been no interruption.

The other registers in the microprocessor 170, are described with the instructions set for facilitating a better understanding of the interaction of these registers. The microprocessor employs instructions of variable length, 1, 2, or 3 bytes. The first byte of any instruction always includes the operation code, while succeeding bytes, numbered 2 or 3, contain address data or operand data, also referred to as immediate data.

The fastest instruction execution requires one microprocessor cycle while the longest instruction requires six processor cycles. An interrupt requires 10 cycles to process. In all designations, bit 0 is the least significant bit.

Instruction Repertoire

The instruction repertoire is described in groups of instructions, all of which have defined instruction word formats. The instructions are defined by the title, mnemonic, number of cycles required by the microprocessor to execute the instruction, number of operands (OP) and the number of bytes in the instruction word. Additionally, breakdown of the command structure of the first byte is given.

REGISTER ARITHMETIC

| Instruction | Mnemonic | Cycles | OP | Bytes |
|---|---|---|---|---|
| Add | AR | 3 | 1 | 1 |
| Subtract | SR | 3 | 1 | 1 |
| Load | LR | 3 | 1 | 1 |
| Store | STR | 3 | 1 | 1 |
| Load/Decrement | LRD | 5 | 1 | 1 |
| Load/Bump | LRB | 5 | 1 | 1 |

The instruction byte is divided into two portions. The most significant 4 bits indicate the instruction code while the lower 4 bits indicate a register within a group of 16 registers as the operand source. All operations are taken to the accumulator register. The Register Arithmetic is 2-byte wide arithmetic.

BYTE ARITHMETIC

| Instruction | Mnemonic | Cycles | OP | Bytes |
|---|---|---|---|---|
| Add | AB | 3 | 1 | 2 |
| Subtract | SB | 3 | 1 | 2 |
| Load | LB | 3 | 1 | 2 |
| Store | STB | 3 | 1 | 2 |
| Compare | CB | 3 | 1 | 2 |
| And | NB | 3 | 1 | 2 |
| Or | OB | 3 | 1 | 2 |
| Xor | XB | 3 | 1 | 2 |

The most significant 5 bits of byte one of the instruction indicate the instruction command while the lowermost 3 bits indicate one of 8 registers. The second byte indicates one of 256 bytes addresses in memory to be used in the arithmetic, i.e., a difference between the register arithmetic and the byte arithmetic is that a byte arithmetic obtains the operand from main memory.

IMMEDIATE ARITHMETIC

| Instruction | Mnemonic | Cycles | OP | Bytes |
|---|---|---|---|---|
| Add | AI | 2 | 1 | 2 |
| Subtract | SI | 2 | 1 | 2 |
| Load | LI | 2 | 1 | 2 |
| Compare | CI | 2 | 1 | 2 |
| And | NI | 2 | 1 | 2 |
| Or | OI | 2 | 1 | 2 |
| Xor | XI | 2 | 1 | 2 |
| Group | GI | 2 | 3 | 2 |

The byte 1 format is the same as for byte arithmetic with the second byte being the operand data. In the last instruction, Group, GI, the immediate data selects the registers in the register group as will become apparent.

ACCUMULATOR ARITHMETIC

| Instruction | Mnemonic | Cycles | OP | Bytes |
|---|---|---|---|---|
| Add 1 | AI | 2 | 0 | 1 |
| Subtract 1 | SI | 2 | 0 | 1 |
| Shift Left | SHL | 2 | 0 | 1 |
| Shift Right | SHR | 2 | 0 | 1 |
| Clear | CLA | 1 | 0 | 1 |
| Transpose | TRA | 1 | 0 | 1 |
| Input Carry | IC | 1 | 0 | 1 |

All 8 bits of byte 1 are used to denote the function to be performed. All operations are conducted within the accumulator. Transpose instruction, TRA, swaps the high and low order register contents of accumulator registers 183 and 185.

| INDIRECTS Instruction | Mnemonic | Cycles | OP | Bytes |
|---|---|---|---|---|
| Store | STN | 4 | 1 | 1 |
| Load | LN | 4 | 1 | 1 |

This is an indirect addressing set of instructions wherein the upper-most 5 bits indicate the function while the lower-most 3 bits signify which of 8 registers are to contain the address in memory to be accessed.

| BIT CONTROL Instruction | Mnemonic | Cycles | OP | Bytes |
|---|---|---|---|---|
| Test/Preserve | TP | 1 | 1 | 1 |
| Test/Reset | TR | 1 | 1 | 1 |

The upper 5 bits of the instruction byte indicate the function while the lower 3 bits indicate a register to be accessed as a mask for testing the accumulator register.

lower order bits for indicating one of 16 registers. In one notation, the plus indication, the binary 0 while the minus indication is a binary 1.

In the branch instructions, except for the BRANCH AND LINK first most significant bits together with the lower two significant bits, indicate the functions. The middle two bits indicate plus or minus 256 register positions or ignore. The BRANCH AND LINK, a 3 byte instruction, selects one of four registers with the lower 2 bits of the command or first byte and uses the uppermost 6 bits as a function indicator. The two bytes are a 15 bit address for the address bus with the second byte being the 8 low significant bits and the third byte being the 7 more significant bits. The RETURN instruction is merely a 1 byte instruction having the same format as the BRANCH AND LINK command byte. The interrupt is not an instruction, but a single signal received over interrupt line I.

ALU CONDITION CODES

The table below indicates the condition code in the ALU low, equal (EQ), or carry set as a result of the executed class of instructions as set forth in the table below.

| Instruction Class | Low | Equal (EQ) | Carry |
|---|---|---|---|
| Register Arithmetic | 16th bit = 1 | All bits (0–15) = 0 | Carry from 16th bit |
| Byte Arithmetic | 8th bit = 1 | All bits (0–7) = 0 | Carry from 8th bit |
| Bit Control | All bits exclusive of bit being tested = 0 | Tested bit = 0 | Unchanged |
| Shift Left | All bits = 0 | 0 was shifted out of the 16th bit | 1 was shifted out of the 16th bit |
| Shift Right | All bits = | 0 was shifted out of the 1st bit | 1 was shifted out of the 1st bit |
| *Logical OR | Results of OR equals all ones | Bits set by OR were all 0's | Unchanged |
| **Logical AND | Preserved bits are all ones | Result of AND equal all 0's | Unchanged |
| Logical XOR | Result all ones | Result all zeroes | Unchanged |
| Input | All bits exclusive of bit = 0 | 8th bit = 0 (Data Input and Output) | Unchanged |
| Input Carry | Always reset | Carry = 0 | Unchanged |
| Compare | Number compared is greater than the byte of accumulator | Number compared equals the contents of the low byte of accumulator | Carry from 8th bit |

*Test the set of bits (set by "or") to be all 0's, and the result for all ones. Does TBS of individual bits. The set bits are indicated by ones in the mask (logical OR).
**Test the preserved bits to be all 0's, all ones, or mixed. The preserved bits are indicated by ones in the mask (logical AND).

| INPUT OUTPUT Instruction | Mnemonic | Cycles | OP | Bytes |
|---|---|---|---|---|
| Input | IN | 4 | 1 | 2 |
| Output | OUT | 4 | 1 | 2 |

The two instructions use the first byte as a command and the second byte to address one of the 256 addresses on the busses, MI, DI, or IO.

| BRANCHES Instruction | Mnemonic | Cycles | OP | Bytes |
|---|---|---|---|---|
| JUMP | J | 3 | 1 | 1 |
| JUMP NOT EQUAL | JNE | 3/1 | 1 | 1 |
| JUMP EQUAL | JE | 3/1 | 1 | |
| BRANCH | B | 3 | 1 | 2 |
| BRANCH NOT EQUAL | BNE | 3/2 | 1 | 2 |
| BRANCH EQUAL | BE | 3/2 | 1 | 2 |
| BRANCH HIGH | BH | 3/2 | 1 | 2 |
| BRANCH AND LINK | BAL | 6 | 2 | 3 |
| RETURN | RTN | 5 | 1 | 1 |
| INTERRUPT | — | 10 | | — |

The first three JUMP instructions are the three most significant bits for indicating the function. A fourth bit for indicating JUMP on plus or minus and the four A Jump instruction does not modify the accumulator 183, 185 or indicator bits whether taken or not. The program counter has had one added to it since it addressed the jump instruction. The program counter 192 includes PCL register 192A and PCH register 192B, hereinafter referred to as counter 192. If taken, the low 4 bits of the instruction first byte replace the low 4 bits of the program counter 92 and the high 11 bits are modified if necessary. The range of the instruction address change is −15 to +17 bytes measured from the jump instruction address. If the destination is within this range, it is only necessary to specify the low 4 bits absolutely of the destination address and a bit to describe which direction (0 for +2 to +17 or 1 for −15 to +0; the +1 condition is not realizable). The +1 condition is not useful because the processor goes to +1 if the jump is not taken (therefore, if it was valid the processor would go to +1 if the jump was taken or not).

In a branch instruction, the program counter 192 has been incremented to point to the second byte of the branch instruction word. The low 8 bits absolute of the destination program address are coded in the data byte (second byte). A code which describes how to modify the high 7 bits is coded into the instruction byte to: leave the high 7 bits the same, add one to the high 7 bits, or subtract one from the high 7 bits.

Branch on Equal and Branch on Not Equal test only the condition of the ALU 181 EQ indicator. Branch on Not low tests only the condition of the Low indicator. Branch on High requires that both the EQ and Low indicators be off.

The BRANCH AND LINK instruction is an unconditional branch that specifies the 16 bit absolute branch address of the program destination and a 2 bit number indicating a register to be used. The address of the next executable instruction (following the BAL) is stored in the register specified by the 2 byte number.

Interrupt is not a programmable instruction but is executed whenever the Interrupt Request line F is activated by an external device and an Interrupt mask in STAT register 195 is equal to zero. Interrupt stops the execution of the program between instructions, reads the new status (register group, interrupt mask, EQ, LOW, CARRY) from the high byte of REGISTER 8, stores the old status in the low byte of REGISTER 8, stores the address of the next instruction to be performed in REGISTER 0, stores the accumulator in REGISTER (without altering the accumulator), and branches to the address specified by the contents of REGISTER 12. The processor always specifies REGISTER GROUP 0 for interrupt. Interrupt requires ten processor cycles to complete. Register groups will be later described.

Return is an uncondition branch to a variable address and can be used in conjunction with the BRANCH AND LINK or to return to the main program after having been interrupted. Two bytes are read from the register specified to define the absolute branch address. A return using register $\phi$ of register group $\phi$ is defined as a return from interrupt. In this case the new status (EQ, LOW, CARRY, interrupt mask and register group) is read from the low order byte of REGISTER 8.

Arithmetic Group instructions operate with the 16 bit accumulator 183, 185 and 8 bit arithmetic-logic unit ALU 181 that are capable of performing various arithmetic and logical operations. Three condition indicators (LOW, EQ, CARRY) are set on the results of some operations. Two's complement 16 bit arithmetic is performed except for byte operations and some immediate operations which are two's complement 8 bit operations. The high order bit is the sign bit; negative numbers are indicated by a one in the sign bit position. Subtraction is accomplished by two's complement addition. Any arithmetic operation that results in a CARRY will set and CARRY latch even though the accumulator may not be changed.

Double Byte Arithmetic is performed with registers 0–15 of the current group for the Add, Subtract, Load and Store instructions. Load Register and Bump (add +1) uses registers 4–7 and registers 12–15. Load Register and Decrement uses registers 0–3 and registers 8–11. In the add register and subtract register instructions, AR, SR, the 16 bits of the addressed or specified register are added to or subtracted from the accumulator and the result is placed in the accumulator. EQ is set if the result is all zeroes. Low is set if the high order bit is a one.

Load Register instruction LR loads 16 bit signal contents of the specified register into the accumulator 183, 185. The contents of the addressed register and unchanged. The ALU 181 indicators are not altered. The Store Register instruction, STR, stores the 16 bit contents of the accumulator 183, 185 into the specified register. The contents of the accumulator 183, 185 and the ALU 181 indicators are not altered.

In the Load Register and Bump, LRD, and Load Register and Decrement, LRB instruction, an absolute one is added to or subtracted from the contents of the specified register, respectively. The result is placed in the accumulator 183, 185 and the specified register. The indicators are updated as for an add or subtract, AB, SB.

For the Byte Arithmetic instructions, bytes 0–511 of memory 64 are addressable by the Byte Arithmetic instructions. The directly addressable memory 172 is divided into two sections: bytes 0–255 are addressable when register groups 0–7 are selected; bytes 256–511 are addressable when register groups 8–15 are selected, as will be later more fully described.

In the instructions AB, SB, CB, LB and STB, the 8 bit contents of the specified byte are added to, subtracted from, compared with, loaded into, or stored from the accumulator register ACL 183, respectively. The high order byte of the accumulator in ACH Register 185 is not disturbed. The ALU 181 condition indicators are set on the result of the single byte arithmetic: add, subtract, and compare. The results of all of the byte operations except compare CB and store STB are placed in the accumulator register 183. Store alters the specified byte. Compare is a subtract operation that does not alter the contents of the accumulator 183, 185. Byte arithmetic is 8 bit signed arithmetic.

In the byte NB, OB and XB instructions, the specified byte is logically ANDed, ORed, or EXCLUSIVE-ORed with the accumulator register 183 contents, respectively. The result is kept in the accumulator register 183. The EQ ALU 181 indicator is set:

for the AND operation if the result of the AND equals all 0's;

for the OR operation if the bits set by the OR were all 0's;

for the EXCLUSIVE-OR operation if there is identify between the byte and accumulator (result = all 0's). The LOW indicator is set:

for the AND operation if the preserved bits are all 1's;

for the EXCLUSIVE-OR operation if the byte and accumulator are bit for bit opposites (result = all 1's). The logical AND can test the mask selected to be all zeroes, all ones or mixed. The mask selected bits are indicated by ones in the corresponding positions of the byte used as the mask. The logical AND tests the bits that are preserved, while the logical OR tests the bits that are then set to one. If only one bit is selected then the logical OR does a test bit and set.

The Immediate Arithmetic instructions AI, SI, CI, LI, NI, OI and XI are the same as the byte operations except that 8 bits of immediate data are used instead of the contents of an addressed byte and the Add and Subtract Operations are 16 bit signed arithmetic rather than 8 bit signed.

The Group Immediate instruction GI takes 8 bits of immediate data to alter the contents of the status indicator register 195 to select register groups and enable or inhibit interrupt. LOW, EQ, and CARRY condition indicators in ALU 81 are not altered. The immediate data (byte two) is divided into five parts. BITS 0–3 are the new register group bits (new register group is coded in binary). BIT 5 is the command bit to put BITS 0–3 into the internal register group buffer if the command bit is a zero. BIT 4 is the new interrupt mask (a one masks out interrupts). BIT 6 is the command bit to put BIT 4 into the internal interrupt mask if the command bit is a zero. BIT 7 is an independent command bit causing the processor to reset its interrupt request latch, if BIT 7 is a zero.

The accumulator arithmetic instructions A1, S1, respectively add or subtract an absolute one to or from the contents of the accumulator 183, 185, and the result is left in the accumulator 183, 185. This is 16 bit signed arithmetic and the ALU 181 condition indicators are set on the result.

The accumulator instructions SHL and SHR shift the signal contents of the accumulator 183, 185 left or right one digit position or binary place, respectively. For shift left, the high order bit is shifted into the CARRY latch (not shown) in ALU 181 and a zero is shifted into the low order bit except when the previous instruction was an input CARRY. After an input CARRY, the CARRY latch condition before the shift is shifted into the low order bit. For shift right, the low order bit is shifted into the CARRY latch, and the state of the high order bit is maintained. When SHIFT RIGHT is preceded by input CARRY, the state of the CARRY latch before the shift is shifted into accumulator 183, 185 Bit 15. EQ condition indicator of ALU 181 is set if a 0 is shifted to the carry latch. LOW condition indicator of ALU 181 is set if the resulting contents of the accumulator 183, 185 is all 0's.

The accumulator instruction CLA clears the accumulator 183, 185 to all 0's. Transpose TRC exchanges the low order register 183 with the high order byte register 85 signal contents. The ALU 181 indicators are unchanged.

The accumulator instruction IC transfers the signal state of signal contents of the CARRY latch to the low order bit of the arithmetic-logic unit 81 on the next following instruction if the next instruction is an add, subtract, bump, decrement, shift left, or compare operation. CARRY is inputted to Bit 15 on a shift right. Interrupt is inhibited by this instruction until the next instruction is performed. The ALU 181 indicators Low is reset and EQ is set if the carry latch is a 0. If the input carry precedes any instruction other than the ones metioned above it will have no effect on instruction execution. If the instruction following the input carry changes the ALU 181 condition indicators, then the indicator information from the input carry is destroyed.

The two Indirect Data Transfer instructions STN and LN can access registers 8–5. Load Indirectly instruction accesses the specified register and uses its contents as an address to fetch a byte of data and load it into the low 8 bits (register 183) of the accumulator without disturbing the high 8 bits (register 185). Store Indirectly accesses the specified register and uses its contents as an address to store the low 8 bits of the accumulator register 183 into the specified byte. The ALU 181 indicators are not altered.

The Bit Test or control instructions TR and TC take specified bit of the low order byte of the accumulator register 183 for test. The ALU 181 condition indicator EQ is set if the bit is a 0. Concurrently the bit is either reset or preserved in the accumulator, respectively.

The Input/Output instructions, IN, OUT, respectively transfer data to the accumulator register 183 from an I/O device (CPP 13 for example) and from the accumulator to an I/O device (CPP 13 for example). These instructions are two cycle operations. The first cycle puts the modified device code on the data out lines, the second cycle is the actual data transfer cycle; the low eight bits of the accumulator in register 183 are outputted to data in lines, and the device code is outputted on the address lines ADC. An OUT instruction does not change the ALU 181 indicators. On an IN instruction, EQ is set if the high order bit of the data inputted is a $\phi$. LOW is set if all other bits are $\phi$. The Input/Output instructions can specify 256 devices each for data transfer. Generally, an I/O device will require more than one device address to specify different types of operations such as READ and TEST STATUS, etc.

A Power On Reset POR initialization places the processor in the following state:

Accumulator = $\phi$
Register Group = $\phi$
Interrupt Mask = 1
LOW, EQ, CARRY = X (unknown)

The microprocessor 170 will begin operation by reading memory location 65,533.

MICROPROCESSOR INSTRUCTION EXECUTION

The processor 170 is pipelined to allow the memory 172 a full processor cycle for access time. To do this, the microprocessor 170 requests a read from memory several cycles ahead of when it needs a data byte. Several restrictions are maintained throughout the instruction set.

1. Each instruction must fetch the same number of bytes as it uses.
2. Each instruction must leave the microprocessor with the next instruction in the INSTRUCTION BUFFER, IB register 196.
3. At "Phase Two Time" at the beginning of Sequence Two, as later described, the TEMPORARY BUFFER (TB) 197 must contain the byte following the current instruction. (Note that this byte was fetched by the previous instruction.)
4. Each instruction decodes "TERM" (Terminate) as later described, which resets the instruction sequence counter (not shown) in clock 176 for CMP 176 and a separate sequence clock (not shown) for CMP 170 to Sequence one, allows the next fetch to be done from the IB 196 and loads the next instruction into IR 198.
5. At "Phase Two Time" at the beginning of instruction Sequence Two the low accumulator register 183 and the high accumulator register 185 must contain the appropriate signals. (Note that the previous instruction may have had other data in these registers during its execution.)

Microprocessor 170 is build exclusively of latch logic. $\phi 2$ signals are the output of latches (or static decodes using the output of latches) that are strobed (sampled or transferred by a clock signal called a strobe) at $\phi 2$ time. $\phi 1$ signals are the outputs of latches (or static decodes using the outputs of latches) that are strobed at $\phi 1$ time. $\phi 1$ signals are used as the inputs to $\phi 2$ latches and $\phi 2$ signals are used as the inputs to $\phi 1$ latches.

Figures 8, 9:
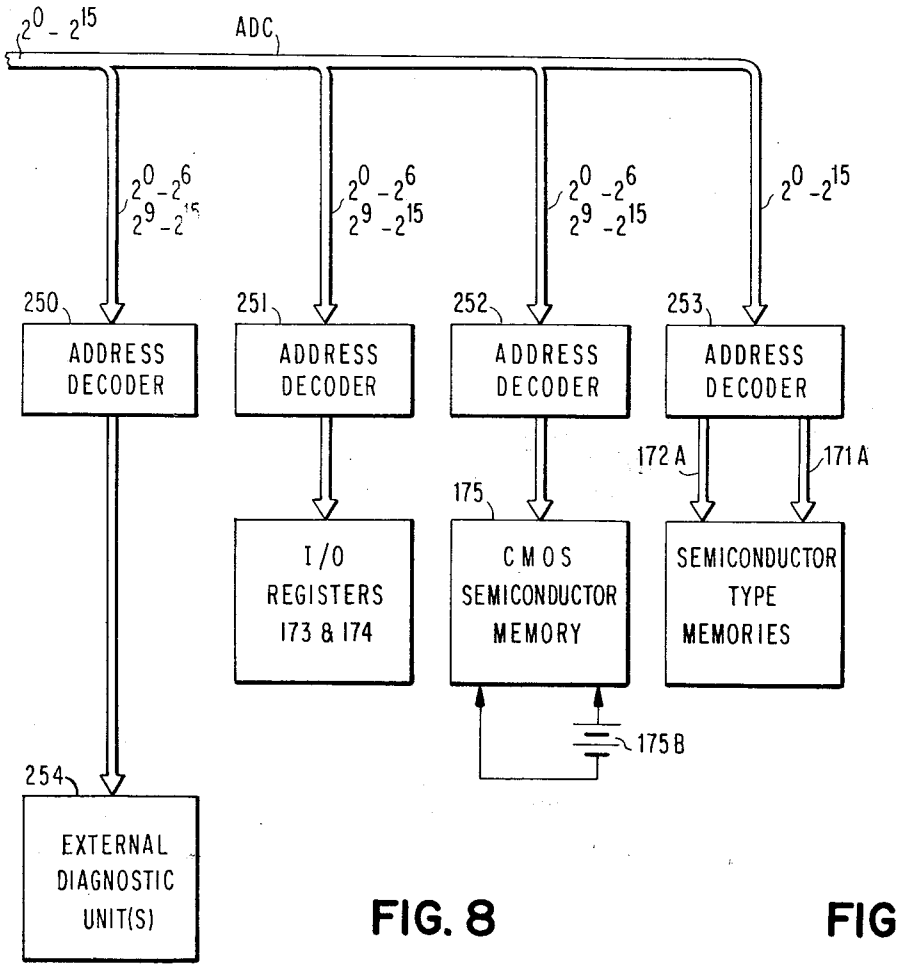
FIG. 8 is a diagram showing addressing elements of the FIG. 3 illustrated control circuits.
FIG. 9 is a chart showing address definition of certain registers used in the FIG. 3 illustrated control circuits.

The fetch decodes (memory references) are done from the IB register 196 at SEQUENCE 1 (SEQ 1), because the IR register 198 is loaded at $\phi 1$, SEQ 1 (FIGS. 7 & 8). At sequences, other than SEQ 1, the fetch decode is done from IR register 198. The fetch decodes are $\phi 2$ signals, and therefore are strobed at $\phi 1$.

The output of the fetch decodes are strobed into registers ALL 191, ALH 190, OL 200 and SCC 180. The program counter 192 is updated from registers AOL 201 and AOH 202 at a $\phi 2$ time. The execution and designation decodes are $\phi 1$ decodes off the IR 198. These decodes are strobed at $\phi 2$ time into SCC 180 to set up the ALU 181 and DESTINATION strobes which occur at $\phi 1$ time. The output signals of ALU 181 are strobed into DB 186, DO 187 or AOH 202 in accordance with the instruction being executed. Then ACL 183 and ACH 185 are updated at $\phi 2$ so another ALU 181 cycle can begin. It takes three processor cycles from the start of a fetch decode to the time that the accumulator 183, 185 is updated. A pipelined configuration means that in some cases a processor can be executing three separate instructions at the same time, as is known in the computer arts.

INSTRUCTION SEQUENCES

An instruction sequence chart in FIGS. 7 and 8 is a convenient shorthand catalog of the internal operation of the processor 170 during each sequence of each instruction. It can be a very useful tool in understanding the processor's operation. This glossary of terms provides the information necessary for proper interpretation of these charts.

General Information

The processor 170 is pipelined. While it is executing one instruction, it reads the next two bytes from memory 172. The first byte is guaranteed in IB 196 at the beginning of SEQ 1 and is used during SEQ 1 to provide three SEQ 1 decodes in SCC 180. At $\phi 1$, SEQ 1, IB→IR where it remains until the next $\phi 1$, SEQ 1. All remaining instruction decodes are done from IR 198.

The second byte is in TB 197 at the beginning of SEQ 2. This byte may contain immediate data for the current instruction or it may be next instruction byte. If it is a next instruction byte, then the current instruction needs to read only one byte from memory to provide the required two bytes. This two byte read occurs for all one byte instructions.

All memory 172 accesses begin at $\phi 1$. The memory data is guaranteed in the data latch register DL 205 via but IO for CMP 170 by $\phi 2$, i.e., one and one-half instruction execution sequences later. In the table below the memory timings for all instructions are set out together with the register destination (dest) from data latch register 205.

MEMORY REFERENCE TIMING TABLE

| Instruction | 1 Start | 1 Dest | 2 Start | 2 Dest | 3 Start | 3 Dest |
|---|---|---|---|---|---|---|
| LR AR SR | 1 | TB | 2 | TB | 3 | TB |
| LRE LRD | 1 | ACL | 2 | ACL | 3 | TB |
| STR | 1 | TB | — | — | — | — |
| AI SI | 1 | TB | 2 | TB | — | — |
| CI GPI LI | | | | | | |
| XI OI NI | 1 | TB | 2 | TB | — | — |
| CB AB SB | | | | | | |
| LB XB OB | | | | | | |
| NB | 1 | TB | 2 | TB | 3 | TB |
| STB | 1 | TB | 3 | TB | — | — |
| Al SI SHL | | | | | | |
| SHR | 1 | TB | 2 | TB | | |
| TRA CLA | | | | | | |
| IC TBP TBR | 1 | TB | | | | |
| BAL | 1 | ACL | 2 | X | 5 | TB |
| RTN | 1 | TB | 2 | ACL | 3 | TB |
| B00 IJO | 1 | TB | 2 | TB | 3 | TB |
| $\overline{\text{B00}}$ $\overline{\text{IJO}}$* | 1 | TB | 2 | TB | | |
| INTERRUPT | 1 | TB | 5 | ACL | 8 | TB |
| | 9 | TB | 10 | TB | | |
| BLI | 1 | TB | 2 | ACL | 3 | TB |
| | 4 | ACL | | | | |
| BSI | 1 | TB | 2 | ACL | 3 | TB |
| IN OUT | 1 | TB | 3 | ACL | 4 | TB |

-continued

| Code | Operation (Phase 2) | Decode |
|---|---|---|
| TB | DL→TB, ACL unchanged | None |
| ACL | DL→ACL, TB unchanged | TACL* or ITAL |
| X | None. ACL and TB are unchanged. Data will be lost unless SDL on line 206 is inhibited by DMA active on line 207. AND circuit 208 blocks 02 from generating SDL signals on line 206. DMA means direct memory access as by registers 173, 174. | NOTB* or TBNS |

*A bar over a jump or branch instruction indicates jump or branch was not taken.

If IR 198 still contains the current instruction byte, the decodes are static. If the decode is for the overlap cycle of SEQ 1 (with the next instruction byte in IR 198), the ALU 181 condition latches are set during the last sequences (3–5) of the current instruction execution. The designated register is decoded by SCC 180. This special case is shown on the instruction sequence charts, FIGS. 7 and 8, by the terms TBNS or ITAL in the ALU columns.

The operation of the processor 170 in each sequence is divided into two catagories: Control Logic (CL) of SCC 180 and ALU and Destination (ALU). The position of these two blocks within the sequence, (i.e., left half or right half) has no meaning. Operations can occur at $\phi 1$ or $\phi 2$ in either catagory. $\phi 1$ occurs in the middle of a sequence. The $\phi 2$ is always a sequence boundary.

Control Logic Glossary

This is a list of terms which appear in the control logic CL columns.

WRITE — WRT

Indicates that a write into memory is initiated at Phase 1 rather than a read. A read is the default condition and requires no decodes. The WRT output line (FIG. 5) is active when WRT appears in the chart.

OUTPUT 1ST I/O — OUT 1IO

Indicates that the first cycle I/O code is placed on the output lines IO at $\phi 1$. Address lines AL9 and AL11 of ADC are driven by the decode IOC1. I/O line is active (FIG. 5).

OUTPUT 2ND I/O — OUT 2IO

Indicates that the second cycle I/O code is placed on the output lines IO to $\phi 1$. Address lines AL10 and AL11 of ADS are driven by IOC2. I/O line is active (FIG. 5).

TB→IB

At each $\phi 2$, SEQ 1 of every instruction, the signal contents of TB register 197 are transferred to IB register 196. The signal contents represent the next successive instruction following the current instruction.

IB SET

Same operation as TB→IB but the intent is to stop IB 196 from following TB 197 rather than save the contents of the TB 197. It is followed at the next $\phi 1$ by IB SET TO "TRA".

IB SET TO "TRA"

Indicates that the reset inputs (not shown) on the IB 196 latches (not shown) are driven at $\phi 1$. CNT OR PORX drives an overlapping set on bits 0, 3 and 5 producing a "TRA" instruction code BAL, POR then execute a TRA to complete their respective operations.

(TERM)

Indicates the end of the instruction. SEQ 1 begins at the doubled line 220 on the chart. The sequence counter (not shown S1-S6) in clock 176 is reset by the decode TERM*.

PCI

Indicates a read from memory and a Program Counter Increment. This action is a default condition and no decodes are needed.

$\phi 1$: PC+1→AO
$\phi 2$: AO→PC

PCNI

A "NO OP". Same as PCI except the PC 192 is not updated at $\phi 2$. The next PCI reads the same location again as though the first read did not occur. It is used because the processor lines signify something every $\phi 1$ and some instructions have no Read/Write or I/O requirements during sequence 1. SPC (Set PC) is inhibited for the jumps and branches, for the shift instructions, and for A1 and S1 instructions.

IBL, IRL, IRH

Indicates a memory access (read or write) to a register. IR (IB) means the register is specified by the low four bits of IR (IB). IB must be used during SEQ 1. IR 198 is used during all other sequences. L means the access is to the low byte of the register, H specifies the high byte. The decode IRSL* (IR selected) controls the formation of the address at $\phi 1$.

| Operation | Control |
|---|---|
| IB(0-3)→AO(0-3) | IBX (SEQ 1 only) |
| IR(0-3)→AO(0-3) | IRX (all other sequences) |
| L=0, H=1→AO(4) | ILH |
| GP(0-2)→AO(5-7) | RGX |
| GP(3)→AO(8) | R3 |
| O→AO(9-14) | TBIR |

TB

Indicates a memory access using the contents of TB 197 as the address. The decode TBSL* (TB selected) controls the formation of the memory address at $\phi 1$.

| Operation | Control |
|---|---|
| TB(0-7)→AO(0-7) | TBX |
| GP(3)→AO(8) | R3 |
| O→AO(9-14) | TBIR |

IRL+8

Same as IRL except 1→AO(3). It is used only in the RTN instruction to read the new status from memory. A one is placed on AL(3).

CAL HIGH BITS, TB→AOL

Indicates a memory access to a location being branched to. The decodes TBSL* and AOSL* control address formation at Phase 1. The high bits are calculated by the counter logic CL for PCH+1 and PCH and by the ALU for PCH−1.

| Phase 1: | Operation | Control |
|---|---|---|
| | TB(0-7)→AO(0-7) | TBX |
| | PCH+1→AO(8-14) | AOSL*=1, BNF=1 |
| | PCH→AO(8-14) | AOSL*=1, BNF=0 |
| | PCH−1→AO(8-14) | AOSL*=0 |
| Phase 2: | AO→PC | |

CAL HIGH BITS, IR→AOL

Similar to TB→AOL above except only the low four bits of the IR are used, and bits 4 through 7 are calculated by the counter logic. The decodes IRSL* and AOSL* control address formation by driving other control lines.

| Phase 1: | Operation | Control |
|---|---|---|
| | IR(0-3)→AO(0-3) | IRX |
| | CL(4-7)→AO(4-7) | None (default) |
| | PCH+1→AO(8-14) | AOSL*=1, JF8=1 |
| | PCH→AO(8-14) | AOSL*=1, JF8=0 |
| | PCH−1→AO(8-14) | AOSL*=0 |
| Phase 2: | AO→PC | |

OL, OH, 4L, 4H, 8L, 8H, 12L, 12H

Indicates a memory access to a register directly specified by the control SCC 180. Occurs only during interrupt. L indicates the low byte, H indicates the high byte.

| Phase 1: | Operation | Control |
|---|---|---|
| | Register→AO(0-3) | CN2, CN3 |
| | L=O, H=1→AO(4) | ILH |
| | O→AO(5-13) | TBIR |
| | 1→AO(14) | R9 |

Update PC, ACL→AOH, TB→AOL

Indicates a memory 172 access to an address specified by the contents of TB and ACL. The address is also placed in PC 192 at $\phi 2$. The address formation is controlled by AOTB* which drives other control lines. ACL 182 goes through ALU 181

| Phase 1: | Operation | Control |
|---|---|---|
| | TB(0-7)→AO(0-7) | TBX |
| | ACL(0-6)→AO(8-14) | SAO |
| Phase 2: | AO→PC | |

ACL→AOH, TB→AOL

Same as above except PC 92 is not updated at Phase 2.

Destination (Dest) Glossary

Items with boxes around them (e.g., ACL to DO→ACL) do not always occur. On Branch or Jump taken the boxed destination occurs only when PCH 192B must be decremented to produce the proper address. The decrement occurs always, it just isn't loaded when it isn't needed. On all other instructions the boxed destination occurs if the instruction is also boxed.

Items in parentheses are "don't care" conditions which occur but are not part of the desired operation.

There are 7 standard data transfers:

| | Phase 1 | Phase 2 | Decodes |
|---|---|---|---|
| 1. | ALU→DO | — | None (default) |
| 2. | ALU→DO | DO→ACL | BF3 |
| 3. | ALU→DB | — | DBDS* |
| | ACH→DO | — | |
| 4. | ALU→DB | DB→ACH | BF2 |
| | ACH→DO | DO→ACL | |
| 5. | ALU→AOH | — | AOTB* |
| | TB→AOL | DB→ACH | |
| | ACH→DO | DO→ACL | |
| 6. | PCL→DO | — | PCSL . PSX |
| 7. | STATUS→DO | — | STSL.PSX |

Any variations of these are decoded separately as exceptions.

MISCELLANEOUS OPERATIONS

Update Status

The new status (REG GROUP, EQ, CARRY, LOW, INT MASK) which has been read from memory replaces the old status.

| | Operation | Decode |
|---|---|---|
| (Phase 1) | TB→STATUS | UPST*, CHST, CHST* |
| (Phase 2) | — | |

Clear ACL & ACH

ACL 182 & ACH 185 are reset to zero by driving the reset inputs of the register latches (not shown).

| | | |
|---|---|---|
| (Phase 1) | — | |
| (Phase 2) | O→ACL, O→ACH | CLAC |

Processor Forced to execute TRA

The IB 196 has been reset to a TRA instruction. The sequence counter (not shown) in clock 176 is reset to SEQ 1 and the processor executes the TRA before the next instruction from memory.

Interrupt is prevented from occurring until after the TRA is completed.

AC7*→EQ

The EQ indicator is set by AC7* (used by I/O instruction), the bit 7 of ACL 183.

IC SETS IC

The Input Carry instruction sets the IC latch (not shown) in ALU 81.

"32"→DO

1→DO(5). Part of POR code.

ALU GLOSSARY

This is a list of terms which appear in the ALU category.

X

ALU NO-OP. No. ALU decodes are provided. ALU 181 output at 182 defaults to all 1's.

ACL±TB

ALU 181 output is either ACL plus TB 197 or ACL 183 minus TB 197 depending on whether instruction was an ADD or a SUBTRACT.

ACL×TB

ALU output is some logical combination of ACL and TB which is dependent on the actual instruction.

ACL

ALU output is ACL.

TB

ALU output is TB.

(MODIF)

ALU output is modified in some manner depending on the instruction. Example: On an IN or OUT instruction, TB→DO except for bits 5 and 6 which are modified to reflect 0 and OUT respectively. ALU output is shown as TB (MODIF).

ACL INCR/DECR

ALU output is ACL plus 1 or ACL minus 1 depending on the instruction.

PCH−1

ALU output is PCH minus 1.

PCH−1+CR

Same as PCH−1 except carry is added.

TBNS, ITAL

ALU NO-OP. The destination of data signals entering the processor at the end of Sequence 1 via register 105 must be specified by the previous instruction (although that instruction is no longer in the machine). To accomplish this action, two sets of latches are necessary. The ALU latches are used as the first set. The ALU latches drive the second set, TBNS and ITAL.

ITAL specifies the ACL as the destination. TBNS specifies no destination. The default condition (no decodes) specifies the TB as the destination.

Memory addressing

The memory addressing of CMP 170 is shown in FIGS. 8 and 9. The address bus ADC goes to a plurality of address decoders 250–253. Decoder 250 decodes the indicated address bits for selecting external diagnostic unit addresses. Such external diagnostic unit addresses are shown in FIG. 7 as being respectively in groups 7, 15, 23 and 31 of the lower 1000 byte address base of the processor address as shown in FIG. 9. Each of the groups include 32 byte addresses. For example, group 0 in zone 0 includes addresses 0–31, and so forth. The address decoder 250 addresses external diagnostic units 254 which are connected to copy production machine 10 via plug (not shown). Diagnostics unit 254 are capable of exercising the copy production machine 10 via processor control in a manner beyond the scope of the present description. Decoder 251 addresses the IO registers which include input registers 173 and output registers 174. It will be remembered that input registers 173 are input only such that CMP 170 can only read the signal contents of such registers; it cannot record in such registers. In a similar manner, output registers 174 can only receive signals from CMP 170 for supplying control signals to CPP 13 and other units of copy production machine 10. It should be noted that the address space for the input/output registers is repeated; i.e., the same address bits will access any I of the input/output registers in all four zones of the memory space. Accordingly, not all address bits are suppled to address decoder 251 in the same manner that bits were eliminated from address decoder 250 for enabling repeated diagnostic address space. This is achieved because the characteristics of the address selection circuits of CMP 170 are faster if all of the addressing for program execution is maintained within the indicated FIG. 8 address zones. Switching zones delays processor action. Reasons for this delay is beyond the scope of the present description.

Address decoder 252 also has the same bits eliminated from its address field for addressing the nonvolatile door CMOS 175. CMOS address space is in groups 4 and 5 of zone 0; 12 and 13 of zone 1; 20 and 21 of zone 2; and 28, 29 of zone 3.

Address decoder 253 addresses ROS control store 171 via address lines 171A and working store memory 172 via address lines 172A to semiconductive type memories. All of the address bits from ADC are applied to decoder 253.

Returning now to FIG. 10, the remaining groups of registers (address space) in the lower 1000 byte address field of CMP 170 also are a part of working store 172 to be addressed via address lines 172A. All address bits are used to access these work registers for uniquely maintaining the signals therein with respect to various programs in CMP 170.

CMP 170 operates within the above-described addressing structures in the following manner. A memory address zone is selected with the work registers in their respective address groups being used for storing intermediate results. References to input/output, diagnostics and the nonvolatile memory 175 is the same for all of the zones, thereby improving efficiency of CMP 170 in avoiding zone switching for accessing such universally used portions of the address space.

The instruction level source code for the duplex mode selection resides in a so-called POR microcode routine invoked upon powering on. Most of the POR routine has no relationship to practicing the present invention and is omitted for brevity and clarity. The code set forth below is that portion of the POR routine directly pertinent to practicing the present invention.

| No. | Instruction | ROS Address |
|---|---|---|
| 1. | If Copies in Duplex (CPYINDP=1) | 00000133 |
| 1. | Then | 00000137 |
| 2. | . Set Duplex Mode Side 2 (DPXSIDE2=1) | 00000138 |
| 2. | . Turn on Duplex Mode Light (DPLXIND=1) | 00000140 |
| 2. | . Suppress AJR (NOAJR=1) | 00000142 |

The two instruction sequence is a branch (#1) that goes to #2 instruction, an OUT instruction if copies are in "dupliex", i.e., interim storage unit 40. The indicator CPYINDP=1 is the signal from switch 41 supplied to input registers 173. Set duplex mode at ROS address 138 sends a signal to output registers 174 for setting duplex latch 66 or by a signal on line 62. SMP 170 at ROS address 140 activates a duplex mode indicating light on panel 52 signifying to the machine user duplex mode has been selected. At ROS address 142 SMP 170 suppresses automatic job recovery for reasons set forth below. The invention is also usable without such suppression. It is apparent that instruction 1 is a two byte instruction and 2 is a three byte instruction.

If the BRNACH INSTRUCTION (#1) finds CPYINDP=1, then SMP 170 fetches an instruction word (not shown) from ROS address 143 to perform a function not related to the present invention.

When copy production machine 10 is in a POR sequence, it is not known by the machine what caused the power turn off. Usually, the power turn off occurs at the end of a work day. It also could be an emergency power off, power failure and the like. In any event, copy production machine 10 contains no indication of the number of copies in interim storage unit 40 whenever copies are present. For automatic job recovery to be successful this number must be accurately indicated. Accordingly, to ensure faithful AJR, that function is suppressed. Of course, machines can be built which could determine the number of copies in interim storage unit 40 for enabling AJR. This action can be achieved by counting the copies as such are transported from interim storage unit 40 to copy path 44. Then, SMP 170 can compare such number with other data indications for implementing a faithful AJR.

While the invention has been particularly shown and described with reference to preferred embodiments thereof, it will be understood by those skilled in the art that various changes in form and details may be made therein without departing from the spirit and scope of the invention.

What is claimed is:

1. A copy production machine having a duplex copy production mode, copy production means having copy path means for transferring images to copy paper being transported therethrough, duplex copy interim storage means, duplex control means to direct single image duplex copies from said copy production means to said interim storage means and completed duplex copies to an output portion of said machine, first means indicating copies in said interim storage means, the improvement including in combination:

power on means indicating a power on sequence; and control means jointly responsive to said first indicating means and to said power on means to actuate said duplex control means to said machine to select copy production in said duplex mode.

2. The machine set forth in claim 1 further including other means indicating other intermediate states and said control means being further responsive to at least another indication to select other copy production modes, respectively, in accordance with said another indication.

3. The machine set forth in claim 1 further including interim means sensing copies in said interim storage means for actuating said first means to indicate copies in said interim storage means.

4. The machine set forth in claim 1 wherein said first means includes nonvolatile memory means for indicating one or more copies should be in said interim storage means from a run prior to any power on sequence.

5. The machine set forth in claim 4 wherein said first means further includes side indicating means for indicating first and second image copy production; and means supplying said first image copy indication to said nonvolatile memory means.

6. A copy production machine having a copy production path for transporting copies of images being reproduced, a plurality of copy producing stations disposed along said path, an exit portion in said path, an interim storage means for receiving single-image duplex copies, means for removing said single-image duplex copies one at a time from said duplex storage means, an entry portion in said path adapted to receive blank copies from a paper supply and said removed single-image duplex copies, said machine being operable in either one of simplex or duplex modes, the improvement including in combination:

means indicating a copy residing in said duplex storage means;

means indicating a power on reset; and means jointly responsive to both said indicating means to actuate said machine to enable a copy production on side two of said residing copy.

7. A copy production machine having a plurality of image processing stations, means including a paper path to transport copies being made past a transfer one of said stations to an exit portion, interim copy storage means in said paper path for storing partially reproduced copies, the improvement including in combination:

means indicating a predetermined intermediate state relating to copy production;

means indicating a power on reset; and means jointly responsive to said indications to automatically enable copy production in accordance with said predetermined intermediate state.

8. A copy production machine having a plurality of copy production modes, including modes for duplex copy production, copy production from one of a plurality of copy sheet sources, and having other copy production modes, each of predetermined ones of said modes having intermediate copy production states identifying such copy production modes, respectively, the improvement including in combination means indicating a power on reset, and means responsive to one of said intermediate copy production states and to said indication to select a respective one of said copy production modes for copy production.

9. The method of operating a document reproduction machine designed to produce double-image duplex copies in a duplex mode, the machine operation in other than said duplex mode, an interim storage unit for storing single-image duplex copies, the steps of:

applying power to said machine in a predetermined power on sequence, during said power on sequence sensing for an intermediate state, and selecting a copy production mode in accordance with said sensed copy production state prior to indicating said machine is ready for copy production.

10. The method set forth in claim 9 further including the steps of:

during said power on sequence sensing for copy sheets in said interim storage means and supplying an indication of copy sheets in said interim storage means as said intermediate state for selecting a duplex mode of copy production.

11. A copy production machine having a copy production portion with a copy sheet path for transporting copy sheets from a one of a plurality of paper supply storage units for supplying sheets of paper for use in connection with a copy production, means in each said unit for indicating a supply of paper therein, a first one of said units is for supplying sheets not previously subjected to a copy production operation by said machine, a second one of said units is for supplying sheets previously subjected to a copy production operation by said machines, characterized in that power on sequence means responds to said means in said second unit to select said second unit to supply paper for copy production.

12. A copy production machine control circuit for a machine having operating means for enabling a plurality of copy production modes and having means for sensing an intermediate state;

characterized in that a power-on sequence control responds to said means sensing said intermediate state to actuate said operating means to operate in a copy production mode in accordance with said sensed intermediate state for said machine before power-on has been completed.

* * * * *